United States Patent [19]

Howard et al.

[11] 4,387,865

[45] Jun. 14, 1983

[54] METHOD FOR STEERING A SOLID PROPELLANT BALLISTIC VEHICLE

[75] Inventors: Peter B. Howard, Arlington; Martin V. Boelitz, Watertown; Thomas W. De Swarte, North Reading, all of Mass.

[73] Assignee: The United States of America as represented by the Secretary of the Navy, Washington, D.C.

[21] Appl. No.: 181,023

[22] Filed: Aug. 25, 1980

[51] Int. Cl.[3] ..... F42B 13/28

[52] U.S. Cl. ..... 244/3.1; 60/234

[58] Field of Search ..... 60/234, 254; 89/1.815; 102/349; 244/3.1

[56] References Cited

U.S. PATENT DOCUMENTS 2,515,051 7/1950 Lloyd ..... 89/1.815

FOREIGN PATENT DOCUMENTS 2315880 10/1973 Fed. Rep. of Germany ..... 244/3.1

OTHER PUBLICATIONS

F. W. Sears, Mechanics, Heat and Sound, "6-3 Body Projected at an Angle", 1950, pp. 100-103.

*Primary Examiner*—Stephen C. Bentley

*Attorney, Agent, or Firm*—R. S. Sciascia; Charles D. B. Curry; Francis I. Gray

[57] ABSTRACT

A method for steering solid propellant ballistic vehicles during powered flight which eliminates the requirement for cutoff control by allowing simultaneous fuel depletion and velocity-to-be-gained, $\overline{V}_G$, nulling. The vehicle booster is steered along a velocity trajectory of length equal to the remaining velocity capability, $V_{CAP}$, which results in a fuel-inefficient trajectory. The trajectory is divided basically into three phases—an exit phase, a fuel-depletion guidance (FDG) phase and a short phase of constant attitude thrusting just prior to final stage burnout. For the exit phase the launch azimuth and the pitch-over magnitude can be varied from their usual fuel-efficient values. During fuel-depletion guidance the additional degree of freedom is the angle, $\theta$, between $\overline{V}_G$ and the desired thrust direction, $\overline{U}_S$, where:

$$\frac{\sin\theta}{\theta} = \frac{|V_G|}{V_{CAP}} \text{ and } \theta = \frac{2|a_T|\theta}{V_{CAP}}$$

$a_T$ being the sensed acceleration vector.

5 Claims, 5 Drawing Figures

METHOD FOR STEERING A SOLID PROPELLANT BALLISTIC VEHICLE

BACKGROUND OF THE INVENTION

1. Field of the Invention

The present invention relates to vehicle guidance methods, and more particularly to a correlated velocity guidance method for steering a solid propellant ballistic vehicle during powered flight which eliminates the requirement for cutoff control in the booster stages.

2. Description of Prior Art

Cutoff control or thrust termination of liquid fueled vehicle boosters is relatively easy due to the ability to shut off the flow of the propellants using valves. However, thrust termination of solid fueled vehicle boosters is relatively complex since additional hardware is required which adds weight and complexity, i.e., reduces payload and/or range, increases cost and increases probability of failure. Even if each booster could be selectively loaded for each range desired, which is impractical, inflexible and more costly, the burn rate fluctuations from a nominal value would still result in an error at booster burnout without cutoff control. Therefore, a method for achieving booster burnout at the desired position and velocity regardless of range without additional hardware for cutoff control is desired.

SUMMARY OF THE INVENTION

Accordingly, the present invention provides a method for steering solid propellant ballistic vehicles during powered flight which eliminates the requirement for cutoff control by allowing simultaneous fuel depletion and velocity-to-be-gained, $\overline{V}_G$, nulling. The vehicle booster is steered along a velocity trajectory of length equal to the remaining velocity capability, $V_{CAP}$, which results in a fuel-inefficient trajectory. The trajectory is divided basically into three phases—an exit phase, a fuel-depletion guidance (FDG) phase and a short phase of constant attitude thrusting just prior to final stage burnout. For the exit phase the launch azimuth and the pitch-over magnitude can be varied from their usual fuel-efficient values. During fuel-depletion guidance the additional degree of freedom is the angle, $\theta$, between $\overline{V}_G$ and the desired thrust direction, $\overline{U}_S$, where:

$$\frac{\sin\theta}{\theta} = \frac{|\overline{V}_G|}{V_{CAP}} \text{ and } \theta = \frac{2|\bar{a}_T|\theta}{V_{CAP}}$$

$\bar{a}_T$ being the sensed acceleration vector.

Therefore, it is an object of the present invention to provide a method for steering a solid fuel ballistic vehicle which achieves a given velocity vector and position at engine burnout without using cutoff controls.

Another object of the present invention is to provide a steering method of high maneuverability which makes it difficult to estimate the launch position.

Yet another object of the present invention is to provide a steering method which is stable at engine burnout.

Still another object of the present invention is to provide a steering method which is flexible for any given range within the range capability of the vehicle fuel load.

Other objects, advantages and novel features will be apparent from the following detailed description when read in conjunction with the appended claims and attached drawing.

DESCRIPTION OF THE PREFERRED EMBODIMENT

Figure 1:
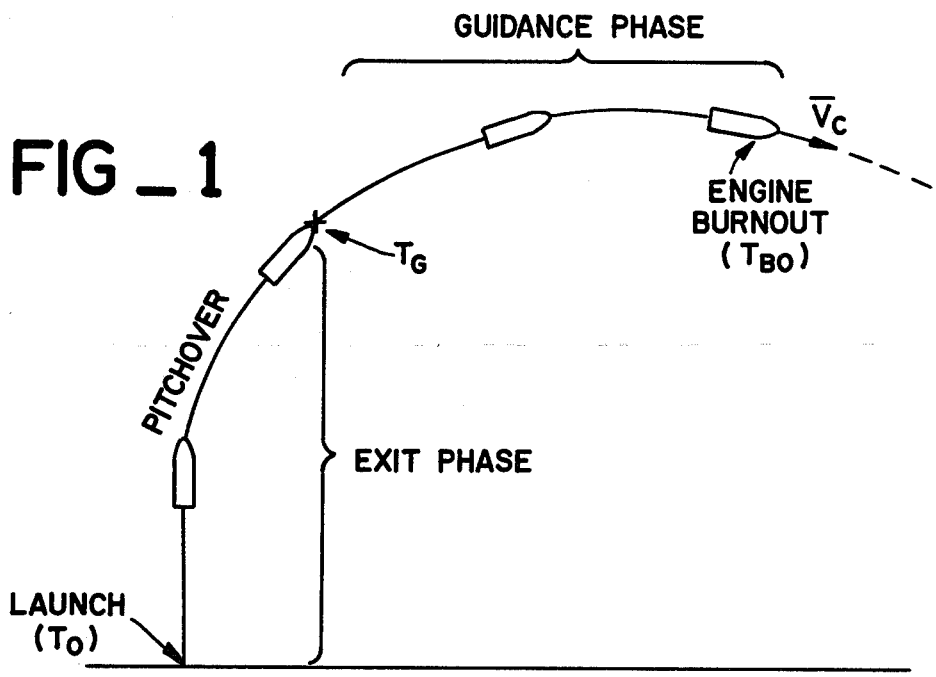
FIG. 1 is a graphic depiction of a nominal ballistic trajectory.

A typical ballistic vehicle boost trajectory as shown in FIG. 1 has an exit phase and an explicit guidance phase which propel the vehicle to obtain a velocity $\overline{V}_C$ such that the vehicle reaches a target at a specified time. The exit phase consists of the initial, essential vertical, launch from a launch facility, whether it be an above-ground tower, an underground silo, or a submarine tube. After the exit phase, which terminates generally after the vehicle has passed through the turbulent atmospheric layers, the explicit guidance phase directs the vehicle to obtain the velocity $\overline{V}_C$ simultaneously with boost engine burnout. For a multi-stage booster the exit phase would coincide with the first stage boost and the explicit guidance phase starts with the second stage initiation. The transition time between these two phases may be specified as $T_G$.

For solid fuel boosters without cutoff control a method has been devised for "wasting" excess fuel so that the booster trajectory is different for each launch according to the desired range having the same propellant load. Short range missions require a large amount of excess fuel to be "wasted". This may be accomplished by using a less-than-efficient trajectory in the exit phase. The launch azimuth and the initial guidance vector, $\overline{U}_{SF}$, can both be varied from their usual values to accomplish this. The launch azimuth and the azimuthal angle of $\overline{U}_{SF}$ can be anywhere from the direction of the target to the opposite direction. The elevation of $\overline{U}_{SF}$ towards which the initial vehicle attitude pitches can be varied to decrease the efficiency of the exit trajectory. By increasing the value of $T_G$, the time at which explicit guidance is begun, it is possible to waste exactly the right amount of fuel so that the required velocity-to-be-gained, $\overline{V}_G$, is just attained at engine burnout, $T_{BO}$.

Figure 2:
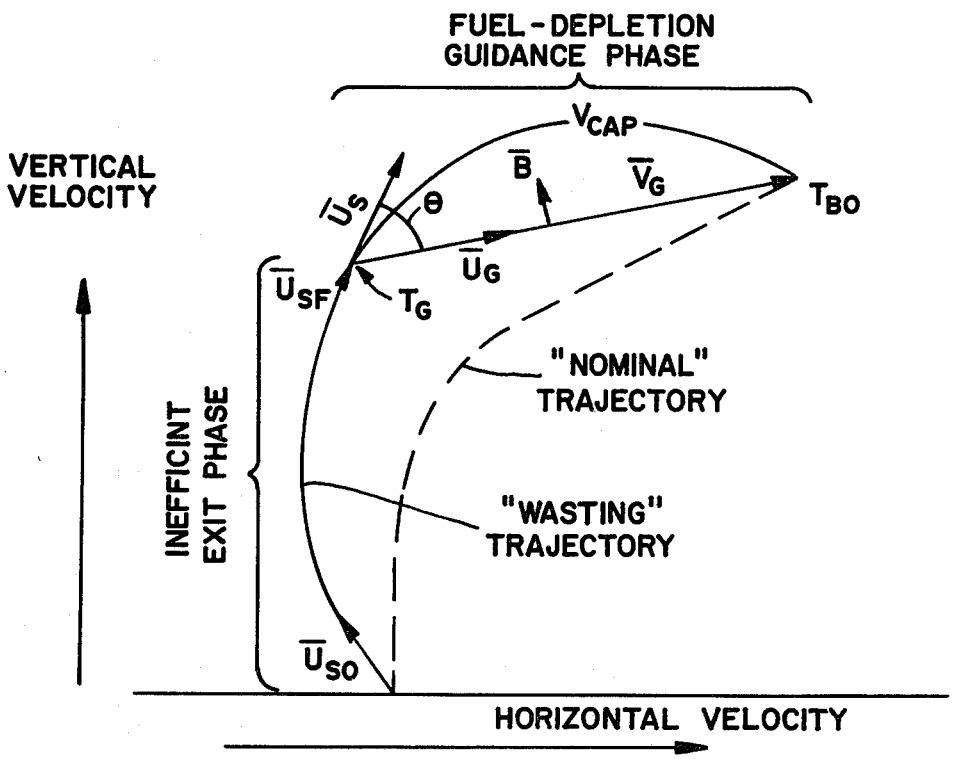
FIG. 2 is a graphic depiction (hodograph) of a fuel wasting trajectory in velocity space according to the present invention compared with a nominal trajectory.

The fuel-depletion guidance (FDG) equations cycle periodically during the booster flight and become more accurate as $T_{BO}$ is approached; they account for some kinds of engine or trajectory perturbations; and they have less impact on targeting, the determination of constants for the particular mission. Therefore, for short mission profiles the exit trajectory provides a coarse wasting option with the FDG equations acting as a vernier. Briefly, the FDG equations provide an accurate estimate of $\overline{V}_G$ and use this estimate to compute a "wasting" angle, $\theta$, between the desired thrust unit vector, $\overline{U}_S$, and $\overline{V}_G$. Referring to FIG. 2 the locus of the gravity-free velocity vector from $T_G$ until $T_{BO}$ is a circular arc, the chord of which is $\overline{V}_G$ at $T_G$ and the length of which is the missile velocity change capability, $$V_{CAP} = \int_t^{T_{BO}} |\bar{a}_T| dt \quad (1)$$

where $\bar{a}_T$ is the sensed missile acceleration vector. In fact the ratio, R, of the length of the chord to the length of the arc is basic to the FDG equations which are in simple form:

$$R = \frac{|\overline{V}_G|}{V_{CAP}}, \quad (2)$$

$$\frac{\sin\theta}{\theta} = R, \quad (3)$$

$$\overline{B} = \text{unit}\,(\overline{D} \times \overline{U}_G), \text{ and} \quad (4)$$

$$\overline{U}_S = \cos\theta\,\overline{U}_G + \sin\theta\,\overline{B} \quad (5)$$

where $\overline{U}_G$ is the unit vector in direction of $\overline{V}_G$ and $\overline{D}$ is a read-in vector which controls the plane of the FDG trajectory.

Essential to the operation of these equations is a method of accurately computing the required velocity for the thrust of finite time duration. This is done using a solution to Lambert's problem in which the current position has been offset, $\overline{V}_C = \overline{V}(\overline{R}_m + \overline{\Delta R}, \overline{R}_T, t_{tf})$. The offset, $\overline{\Delta R}$, depends on the acceleration profile, both in magnitude and direction:

$$\overline{\Delta R} = -K_{PO}(t) V_{CAP} |\overline{V}_G| (\overline{V} - \overline{B}\theta/3) \quad (6)$$

The quantity $K_{PO}(t)$ is defined as:

$$K_{PO}(t) = \frac{\int_t^{T_{BO}} (\tau - t)\,|\bar{a}_T(\tau)|\,d\tau}{\left[\int_t^{T_{BO}} |\bar{a}_T(\tau)|\,d\tau\right]^2} \quad (7)$$

The key to good performance of the FDG equations is an accurate estimate of $\overline{V}_G \cdot \overline{V}_G$ at any point during powered flight is $\overline{V}_C - \overline{V}$ and depends on the future thrust acceleration. As the end of the thrust time is approached the estimate becomes more and more accurate. If the estimate of $\overline{V}_G$ errs on the high side during the thrust period, it will begin to decrease as the burn ends. The value of R will be larger than appropriate at the time it should be approaching unity. $\theta$, defined for computational purposes as $K_\theta\sqrt{6(1-R)}$, can increase dramatically since a small error in the estimated $\overline{V}_G$ can give a large error in R. Thus, even though the final residual $\overline{V}_G$ is quite small, the guidance may command a high turning rate in order to deplete it before the imminent end of the burn. This is avoided by freezing the guidance command at some point.

Figure 3:
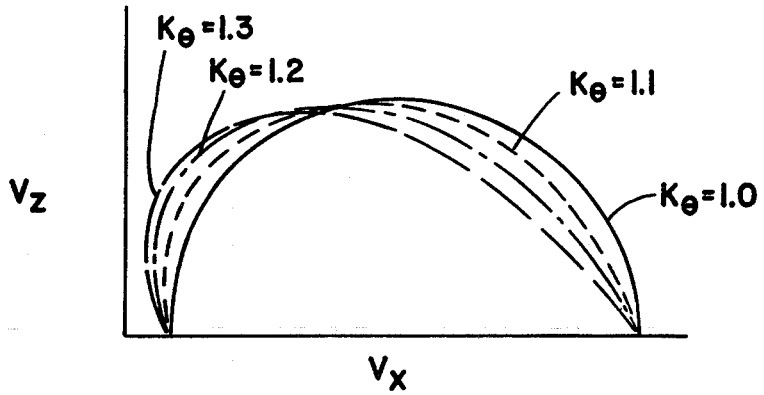
FIG. 3 is a graphic depiction (hodograph) of the effect of the wasting angle constant upon the wasting trajectory.

The later the guidance freeze point is, the lower the $\overline{V}_G$ residuals at burnout. In fact the residual will be equal to the excess $V_{CAP}$ at that point. By adjusting various constants in the equations it is possible to cause R to go to unity before the end of the burn. This will cause the residuals to equal the error in $\overline{V}_G$ at that point. Although this error can be quite small for a nominal engine burn, it is significantly larger for faster or slower engine burns, i.e., $\overline{V}_G$ is a strong function of burn time. This error is minimized by properly adjusting various read-in constants. The function $K_{PO}$ and the value of $K_\theta$ can both be adjusted to achieve a stable $\theta$. A value of $K_\theta$ greater than unity causes extra wasting early in the fuel depletion arc to reduce the wasting later as shown in FIG. 3. A better procedure is to tailor $K_{PO}$, which depends only on the engine thrust profile, to reduce residuals resulting from non-nominal burn times as computations are simpliied using a circular arc.

The denominator of equation (7) is the square of $V_{CAP}$. If $K_{PO}$ for a nominal engine is used and the engine burns fast, $\theta$ will be unstable near the end of the burn because $K_{PO}$ is larger than the correct value, making the position offset larger, which in turn makes $\overline{V}_G$ slightly larger than it should be. Approaching the end of the burn the error in $\overline{V}_G$ goes to zero so there is an unaccountably large amount of wasting which causes instability. If appropriate values for $K_{PO}$ are used, this instability is avoided. However for slow burns $\theta$ will go to zero before all the wasting is done. This leaves a residual approximately equal to the error in $\overline{V}_G$ at the time $\theta$ goes to zero. This effect is minimized by defining $K_{PO}$ as a second order polynomial. As the faster burning engines burn out, the values of the fitted $K_{PO}$ follow the values of the longer burning engines. Making $K_{PO}$ a function of time yields smaller residuals than making it a function of $V_{CAP}$.

By beginning with a linear $K_{PO}$ for the long after $T_G$ and ending with the fitted $K_{PO}$ as the burn approaches $T_{BO}$, underwasting occurs during the early portion of the FDG phase. This would be equivalent to using the linear $K_{PO}$ for a second stage burn and the fitted $K_{PO}$ for a third stage burn for a three-stage vehicle. This insures that fuel needed for barely accessible targets is not wasted early when the error in estimated $\overline{V}_G$ is relatively large. Biasing the value of $V_{CAP}$ at the start of FDG is another way to insure against overwasting.

The value of $V_{CAP}$ for the FDG phase is a variable to be read into a flight computer. There are many reasons for biasing $V_{CAP}$ to some value other than the true best estimate value. $V_{CAP}$ for the final stage might be overestimated so that at burn-out the additional $\overline{V}_G$ is along the vehicle thrust axis. The bias value could be equal to the three-sigma value of the $V_{CAP}$ deviation distribution.

Depending on whether the mission is long or short range, the $V_{CAP}$ at initiation of the FDG phase may be biased low or high. For long-range missions it is mandatory not to waste fuel on erroneous $\overline{V}_G$ and $V_{CAP}$ estimates and thus fall short of target. Errors in $\overline{V}_G$ are due to burn-time perturbations, theoretical limits on the accuracy of the position offset Lambert solution especially as applied to a rotating thrust vector, and approximations made when implementing the guidance equations. $V_{CAP}$ can be in error due to uncertainties in vehicle weight, propellant weight, specific impulse and estimated drag. To avoid wasting fuel that for the above reasons may not be available, the $V_{CAP}$ would be biased low enough so that in the worst case there is still a small amount of wasting to be done toward the end of the FDG phase. At the start of the last stage of the FDG phase the read-in value for that stage comes into use. Any errors in this $V_{CAP}$ lead directly to $\overline{V}_G$ errors at burnout. Theoretical and implementation errors in $\overline{V}_G$ go to zero as the end of burn is approached. Residuals due to burn-time perturbations are minimized by defining $K_{PO}$ as indicated supra.

For short missions with large excess $V_{CAP}$ it might be thought that biasing $V_{CAP}$ high during the initial FDG phase would cause extra wasting to be done early and result in lower turning rates and better performance during the final stage of the FDG phase. However, this idea is not very effective. If $V_{CAP}$ used at the start of the FDG phase is not biased by the same amount as at the start of the last part of the FDG phase, there will be a discontinuity in the guidance computer thrust direction at the start of the last part of the FDG phase which should not be large. It is possible to estimate acceleration integrals more easily along circular areas of different radii than along distorted arcs caused by use of the factor $K_\theta$. Experimental results show that although $\theta$ at the start of the last part of the FDG phase is reduced by biasing $V_{CAP}$ at the start of the FDG phase, the effect on the $\overline{V}_G$ residual is small. Thus, biasing $V_{CAP}$ for short-range missions is not worth the effort.

Figure 4:
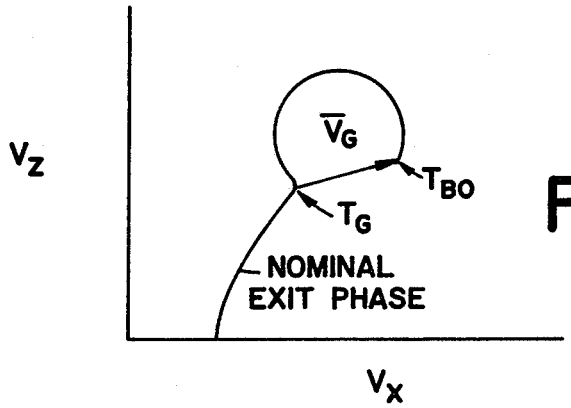
FIG. 4 is a graphic depiction (hodograph) of the effect of a nominal exit phase upon the wasting trajectory for short ranges.

The FDG equations cause $\overline{V}_G$ to rotate through an angle equal to $\theta$ at time $T_G$. In instances of large excess $V_{CAP}$ the final $\overline{V}_G$ direction can be opposite in direction from what might be considered normal as shown in FIG. 4. One method of affecting this final direction is independent of the FDG equations and requires using an inefficient exit trajectory as discussed supra and as shown in FIG. 2. Doing this simply means there is less excess $V_{CAP}$ for the FDG phase of flight and thus a smaller $\theta$.

Figure 5:
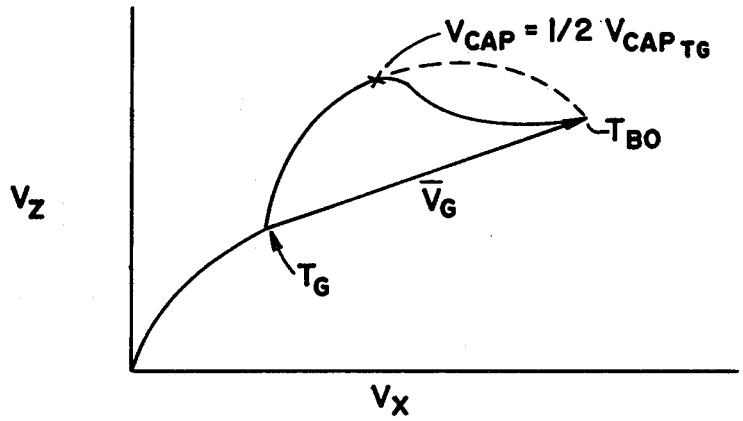
FIG. 5 is a graphic depiction (hodograph) of the effect of arc sign reversal during the fuel-depletion guidance phase upon the wasting trajectory.

A second method for changing the final direction of $\overline{V}_G$ requires a change in the guidance algorithm to change the sign of B at some point, i.e., reverse the curvature of the wasting arc as shown in FIG. 5. If this change is at a point where $V_{CAP}$ is one-half its value at $T_G$, the final $\overline{V}_G$ direction would be approximately equal to its direction at $T_G$. By varying the time of the sign change the final $\overline{V}_G$ direction can be placed anywhere between $\pm\theta$ at $T_G$.

Thus, a typical powered ballistic vehicle trajectory is determined by the range to the target and the nominal vehicle velocity capability for each stage. The exit phase is adjusted to provide for coarse wasting of excess fuel ranging from a nominal trajectory for long range targets to a reverse, fuel-inefficient trajectory for short range targets. The pitchover rate also is determined according to the expected velocity-to-be-gained vector at guidance transition, $T_G$, which will place the vehicle at the specified point with the appropriate velocity vector at engine burnout to reach the target. A correction to $V_{CAP}$ at $T_G$ for long ranges to compensate for fluctuations from nominal engine burn is input at the start of the fuel depletion guidance phase and assures that there is sufficient fuel to achieve the target. The position offset is computed cyclically based upon the sensed acceleration using a linear position offset constant as a function of time for the second stage. This appropriate steering vector, $\overline{U}_S$, is computed cyclically and the vehicle is steered accordingly along an arc of a circle whose chord is $\overline{V}_G$, the angle between $\overline{U}_S$ and $\overline{V}_G$ being the wasting angle. The curvature of the arc is a function of the range, being less for long ranges and more for short ranges, depending upon the amount of fuel that needs to be wasted. At third stage ignition a fitted second order polynomial value of $K_{PO}$ is used to compensate for non-nominal burn rates which could cause guidance instability at engine burnout. As the ratio of $V_{CAP}$ to $|\overline{V}_G|$ becomes one prior to engine burnout, the guidance is frozen. The result is an accurate method for steering a solid fueled ballistic vehicle to obtain a given velocity vector for any range within the fuel load capability of the vehicle without using cutoff controls.

We claim:

1. A method for steering a solid propellant ballistic vehicle during powered flight which eliminates the requirement for cutoff control in booster stages, said method comprising the step of steering said vehicle along a fuel-inefficient trajectory such that at engine burnout ($T_{BO}$) said vehicle has obtained a velocity vector which will enable said vehicle to reach the desired target at a desired time, said fuel-inefficient trajectory including:

(a) an exit phase which is a function of vehicle launch parameters;

(b) a fuel-depletion guidance (FDG) phase taking place in a plane perpendicular to a predetermined read-vector ($\overline{D}$), said FDS phase comprising an arc circle whose chord is $\overline{V}_G$ at transition from said exit phase to said FDG phase, said arc being defined by the equation $$\frac{\sin\theta}{\theta} = \frac{|\overline{V}_G|}{V_{CAP}}$$

where $\theta$ is the angle between the vehicle thrust vector ($\overline{U}_S$) and $\overline{V}_G$, $V_{CAP}$ is the remaining vehicle velocity capability and, $\overline{V}_G$ is the remaining velocity-to-be-gained vector, and;

(c) a guidance freeze phase just prior to said $T_{BO}$ to prevent guidance instabilities at said $T_{BO}$.

2. A steering method as recited in claim 1 wherein said FDG phase further comprises means for recomputing $\theta$ on a cyclical basis throughout said FDG phase to compensate for engine burn anomalies.

3. A steering method as recited in claim 2 wherein said FDG phase further comprises means for accurately computing the required velocity for an engine burn of definite time duration by calculating a position offset ($\overline{\Delta R}$) for Lambert's problem as follows:

$$\overline{\Delta R} = -K_{PO}(t)V_{CAP}|\overline{V}_G|(\overline{V} - \overline{B}\theta/3)$$

where the constant $K_{PO}(t)$ is a function of the acceleration profile and is linear initially and a fitted second order polynomial as engine burn approaches said $T_{BO}$.

4. A steering method as recited in claim 3 wherein said FDG phase further comprises biasing $V_{CAP}$ low for long range missions so that there is still a small amount of wasting of fuel to be done near the end of said FDG phase.

5. A steering method as recited in claim 4 wherein said FDG phase further comprises means for reversing the curvature of said arc to change the final $\overline{V}_G$ direction.

* * * * *